US008356984B2

(12) United States Patent
Wang

(10) Patent No.: US 8,356,984 B2
(45) Date of Patent: Jan. 22, 2013

(54) HAND AIR PUMP HAVING GAUGE DEVICE

(75) Inventor: Lo Pin Wang, Taichung (TW)

(73) Assignee: Beto Engineering & Marketing Co., Ltd., Taichung (TW)

( * ) Notice: Subject to any disclaimer, the term of this patent is extended or adjusted under 35 U.S.C. 154(b) by 239 days.

(21) Appl. No.: 12/930,228

(22) Filed: Dec. 30, 2010

(65) Prior Publication Data

US 2012/0171053 A1 Jul. 5, 2012

(51) Int. Cl.
*F04B 49/00* (2006.01)
*F01B 11/02* (2006.01)

(52) U.S. Cl. ..... 417/63; 92/128; 92/169.1

(58) Field of Classification Search ..... 417/63, 417/555.1; 92/169.1, 128; 73/37
See application file for complete search history.

(56) References Cited

U.S. PATENT DOCUMENTS

| | | | | |
|---|---|---|---|---|
| 1,425,614 | A | 8/1922 | Sticket | |
| 2,576,687 | A | 11/1951 | Krehbiel | |
| 3,907,461 | A | 9/1975 | Bouder | |
| 3,981,625 | A | 9/1976 | Wickenberg | |
| 4,673,007 | A | 6/1987 | Huang | |
| 4,985,181 | A * | 1/1991 | Strada et al. | 261/87 |
| 5,964,577 | A | 10/1999 | Chuang | |
| 6,485,264 | B1 | 11/2002 | Wu | |
| 6,558,129 | B2 | 5/2003 | Wang | |
| 6,739,842 | B2 * | 5/2004 | Wu | 417/63 |
| 6,805,537 | B2 | 10/2004 | Wu | |
| 7,331,768 | B2 | 2/2008 | Wu | |
| 2010/0180957 | A1 * | 7/2010 | Wu | 137/223 |

* cited by examiner

*Primary Examiner* — Charles Freay

(57) ABSTRACT

A hand air pump includes a connecting member having a barrel and an outlet port and a mouth, a receptacle having a cylinder engaged onto the barrel and having a slidable piston, the receptacle includes a channel for engaging with a cover plate which includes a longitudinal hole communicative with the mouth of the connecting member, and a gauge device includes a notch for receiving the receptacle and includes one or more latching members for retaining the gauge device to the receptacle and includes a connector engaged with the hole of the cover plate for receiving the pressurized air from the cylinder and for measuring an air pressure within the cylinder.

12 Claims, 7 Drawing Sheets

HAND AIR PUMP HAVING GAUGE DEVICE

BACKGROUND OF THE INVENTION

1. Field of the Invention

The present invention relates to a hand air pump, and more particularly to a hand air pump including a gauge device that may be easily and quickly and readily assembled to the hand air pump without additional tools and that may be easily and quickly manufactured with a decreased manufacturing fee.

2. Description of the Prior Art

Typical hand air pumps comprise a cylindrical housing or pump barrel including a chamber formed therein for slidably receiving or engaging with a piston and a piston rod therein, and a tube coupled to an air passage of the pump barrel for receiving the pressurized air from the pump barrel and for supplying the pressurized air to an air nozzle.

For example, U.S. Pat. No. 1,425,614 to Stickel, U.S. Pat. No. 2,576,687 to Krehbiel, U.S. Pat. No. 3,981,625 to Wickenberg, and U.S. Pat. No. 4,673,007 to Huang disclose several of the typical air liquid pumps each also comprising a hollow cylinder having a chamber for slidably receiving or engaging with a piston and a piston rod therein which may be moved relative to the hollow cylinder to generate a pressurized air and to supply the pressurized air to inflate various objects, such as vehicle tires, shoes, inflatable balls or the like, and further comprising a manometric gauge device for measuring or indicating the air pressure within the hollow cylinder.

However, the numerals of the graduations of the manometric gauge device are formed or provided on the outer peripheral portion of the cylinder and may not be easily and clearly seen or read by the users.

U.S. Pat. No. 3,907,461 to Bouder, and U.S. Pat. No. 6,805,537 to Wu disclose two further typical hand air pumps each comprising a manometric gauge or pressure measuring device including a screw or threaded member for assembling to or detaching from a connecting member of a hollow cylinder or pump barrel or casing.

However, the manometric gauge or pressure measuring device will be extended out of the pump barrel or casing or cylinder and may be rotated relative to the pump barrel to a position that may not be easily seen or read by the users.

U.S. Pat. No. 5,964,577 to Chuang, and U.S. Pat. No. 6,558,129 to Wang disclose two further typical hand air pumps each comprising a manometric gauge or pressure measuring device pivotally or rotatably coupled to the cylinder or pump barrel without a mount.

However, the pivotal coupling structure of the manometric gauge or pressure measuring device to the cylinder or pump barrel is complicated and may not be easily and quickly manufactured and may have a greatly increased manufacturing fee.

U.S. Pat. No. 6,485,264 to Wu discloses a still further typical hand air pump comprising a manometric gauge or pressure measuring device attached or mounted to the cylinder or pump barrel with a pressure gauge seat and an attaching member and a coupling conduit.

However, the pressure gauge seat and the attaching member and the coupling conduit are extended out of the cylinder or pump barrel and may spoil the outer appearance of the typical hand air pump.

U.S. Pat. No. 7,331,768 to Wu discloses a still further typical hand air pump comprising a manometric gauge or pressure measuring device attached or mounted to the cylinder or pump barrel with a coupling collar and a connecting tube and two or more joints.

However, the coupling collar and the connecting tube are extended out of the cylinder or pump barrel and may spoil the outer appearance of the typical hand air pump.

The present invention has arisen to mitigate and/or obviate the afore-described disadvantages of the conventional gauge devices for the hand air pumps.

SUMMARY OF THE INVENTION

The primary objective of the present invention is to provide a hand air pump including a gauge device that may be easily and quickly and readily assembled to the hand air pump without additional tools and that may be easily and quickly manufactured with a decreased manufacturing fee.

In accordance with one aspect of the invention, there is provided a hand air pump comprising a connecting member including a barrel having a bore formed in the barrel, and including an outlet port and a mouth communicative with the bore of the barrel, a receptacle including a cylinder disposed in the receptacle for forming a space between the receptacle and the cylinder, and including a channel formed in the receptacle and communicative with the space that is formed between the receptacle and the cylinder, the cylinder being engaged onto the barrel and including a chamber formed therein and communicative with the bore of the barrel, the mouth of the connecting member being extended into the space that is formed between the receptacle and the cylinder, a piston slidably engaged in the chamber of the cylinder and movable along the chamber of the cylinder for generating a pressurized air and for supplying the pressurized air into the bore of the barrel and into the outlet port and the mouth of the connecting member, a cover plate engaged with the channel of the receptacle and including a longitudinal hole formed therein and communicative with the mouth of the connecting member, and a gauge device including a notch formed therein for receiving and engaging onto the receptacle, and including at least one latching member engaged with the receptacle for retaining the gauge device to the receptacle, and including a connector extended from the gauge device and engaged with the hole of the cover plate for receiving the pressurized air from the connecting member and the cylinder and for measuring an air pressure within the cylinder.

The connecting member includes a tube extended from the barrel and having a compartment formed in the tube, the outlet port and the mouth are extended from the tube.

The connecting member includes a peripheral shoulder formed in an outer peripheral portion of the barrel and engaged with the receptacle.

A base may further be provided and includes a chamber formed therein for receiving the connecting member, and includes an opening and an orifice formed in the base and communicative with the chamber of the base for receiving and engaging with the mouth and the outlet port of the connecting member respectively.

A nozzle may further be provided and coupled to the outlet port of the connecting member. The notch of the gauge device includes a curvature similar to that of the receptacle.

The receptacle includes two flanges to form the channel between the flanges, and includes a groove formed in each of the flanges for slidably receiving and engaging with two side portions of the cover plate.

The gauge device includes a slot formed in the latching member for slidably receiving and engaging with the flange of the receptacle and for retaining the gauge device to the receptacle.

The cover plate includes a longitudinal pipe provided therein and located in the space that is formed between the receptacle and the cylinder, and the hole is formed in the pipe, and the pipe includes a lower portion attached to the mouth and includes an upper portion engaged with the connector of the gauge device.

The receptacle includes a cap mounted on top thereof, and the cap includes an aperture formed therein for slidably receiving and engaging with a piston rod which is extended from the piston.

A second cover plate may further be provided and engaged with the channel of the receptacle and disposed between the gauge device and the cap.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 8:
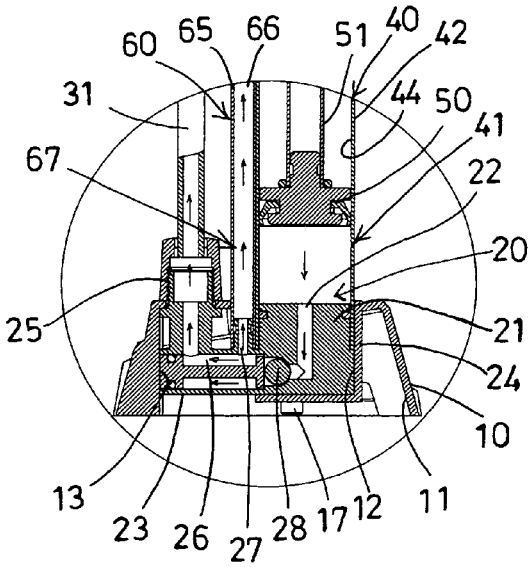

Referring to the drawings, and initially to FIGS. 1-7, a hand air pump in accordance with the present invention comprises a base 10 including a chamber 11 formed therein (FIGS. 2, 7, 8), and including an opening 12 and an orifice 13 formed therein, such as formed in the upper portion thereof and opened upwardly and communicative with the chamber 11 thereof, and including one or more (such as two) flaps or panels or foot plates 14, 15 laterally extended outwardly therefrom for being engaged with or stepped by the users. It is preferable, but not necessarily that the opening 12 of the base 10 includes an inner diameter greater than that of the orifice 13 of the base 10.

A connecting member 20 is disposed or engaged into the chamber 11 of the base 10 and secured or coupled to the base 10 with latches or fasteners 17 or the like, and includes a barrel 21 for engaging into the opening 12 of the base 10, and includes a bore 22 formed in the barrel 21, and includes a tube 23 laterally extended from the barrel 21 and received or engaged in the chamber 11 of the base 10, and includes a peripheral shoulder 24 formed in the outer peripheral portion of the barrel 21, and includes an outlet port 25 extended from the tube 23 and received or engaged into or through the orifice 13 of the base 10 for coupling to the mouthpiece or nozzle 30 with a hose 31 or the like, in which the tube 23 includes a bore or compartment 26 formed therein (FIGS. 1, 3, 8) and communicative with the bore 22 of the barrel 21 and also communicative with the outlet port 25 of the barrel 21 or of the connecting member 20.

The connecting member 20 further includes another outlet port or mouth 27 also extended from the tube 23 and received or engaged into the opening 12 of the base 10 and communicative with the compartment 26 of the tube 23 and/or the bore 22 of the barrel 21, and includes a valve device 28, such as a check valve 28 disposed or attached or mounted or engaged in the barrel 21 and located between the bore 22 of the barrel 21 and the compartment 26 of the tube 23 (FIG. 8) for controlling or limiting the air or liquid to flow from the bore 22 of the barrel 21 into the compartment 26 of the tube 23 only, and for preventing the air or liquid from flowing backwardly from the compartment 26 of the tube 23 into the bore 22 of the barrel 21.

Figure 1:
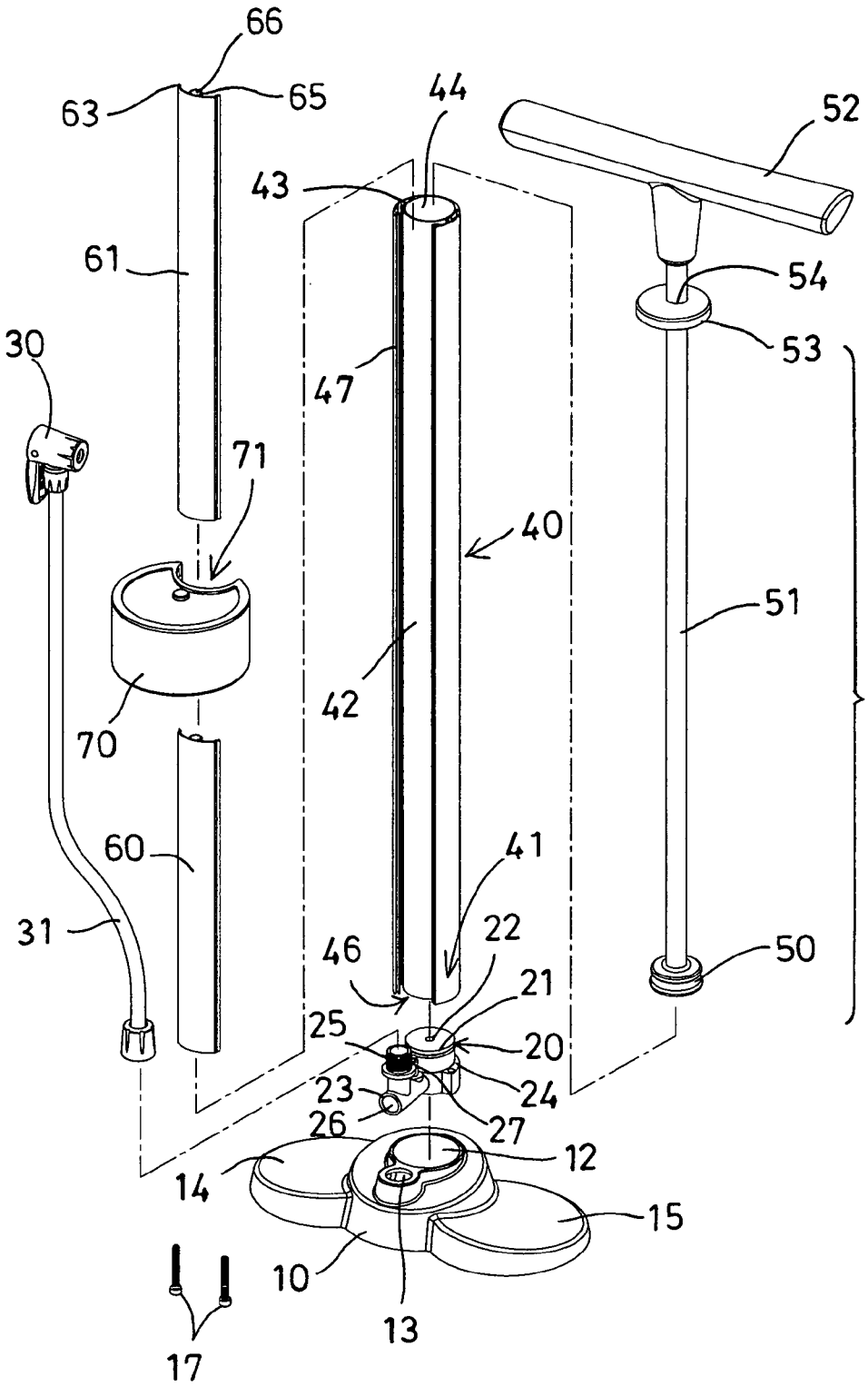
FIG. 1 is a partial exploded view of a hand air pump in accordance with the present invention.
Figure 2:
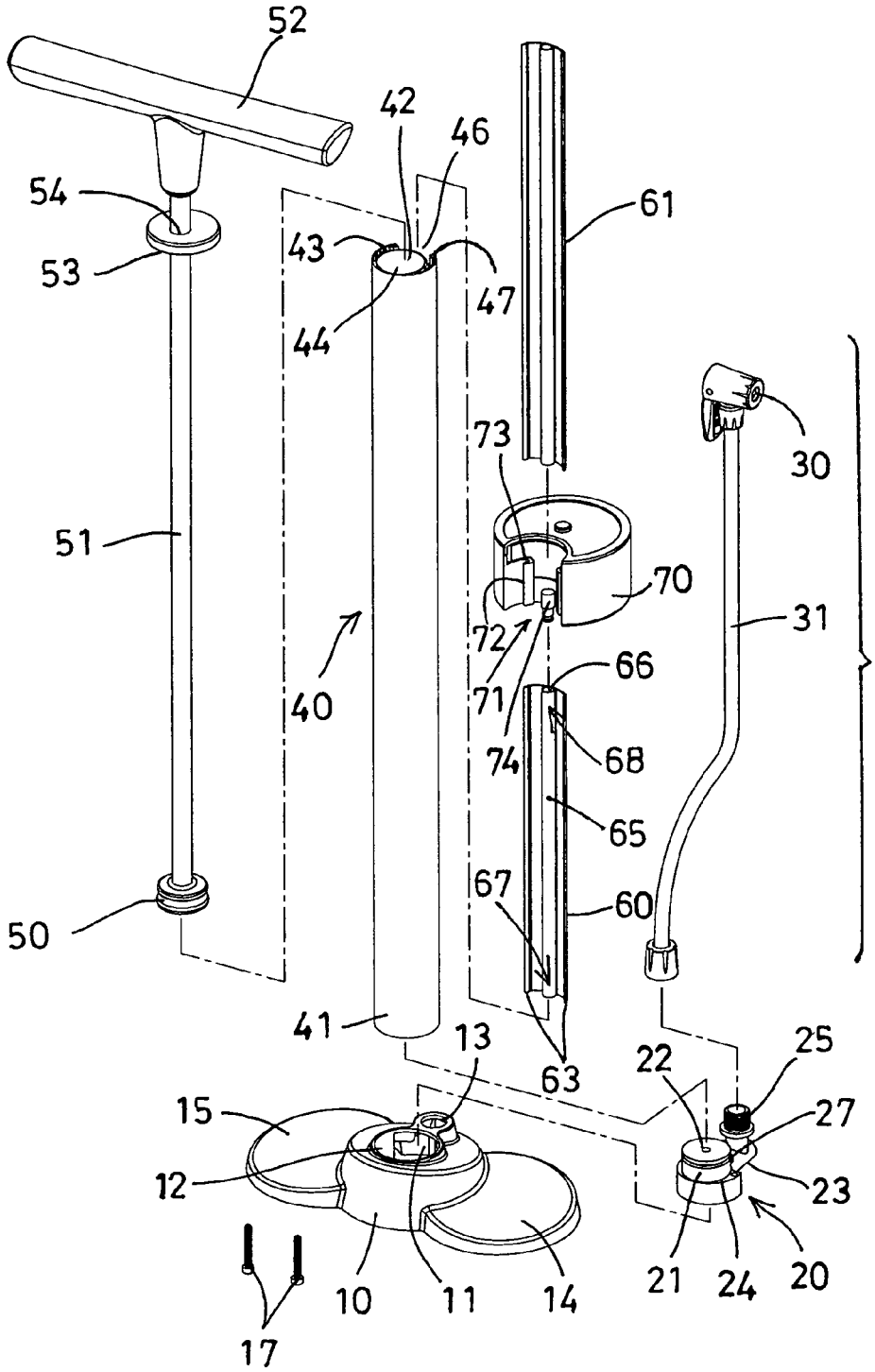
FIG. 2 is another partial exploded view similar to FIG. 1, but seen from an opposite direction as that shown in FIG. 1.
Figure 4:
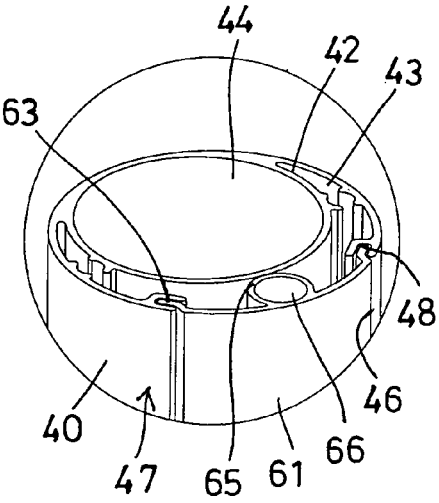
FIG. 4 is an enlarged partial perspective view of the hand air pump.
Figure 3:
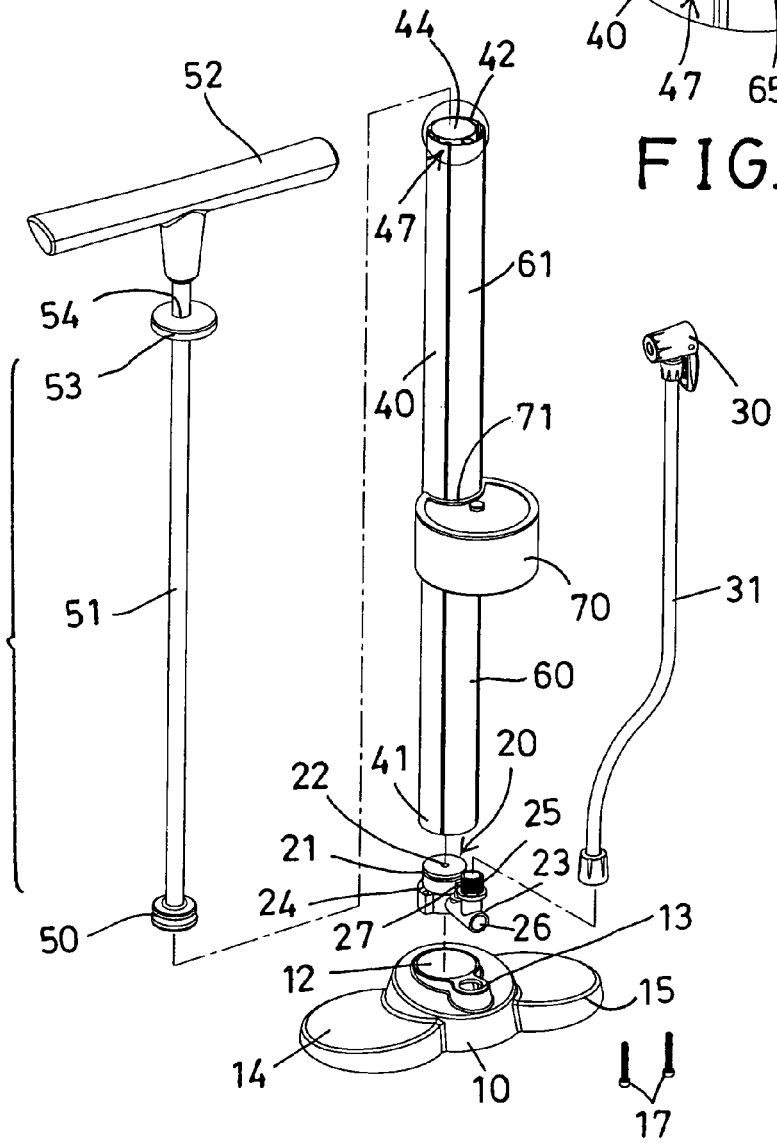
FIG. 3 is a further partial exploded view of the hand air pump.
Figure 5:
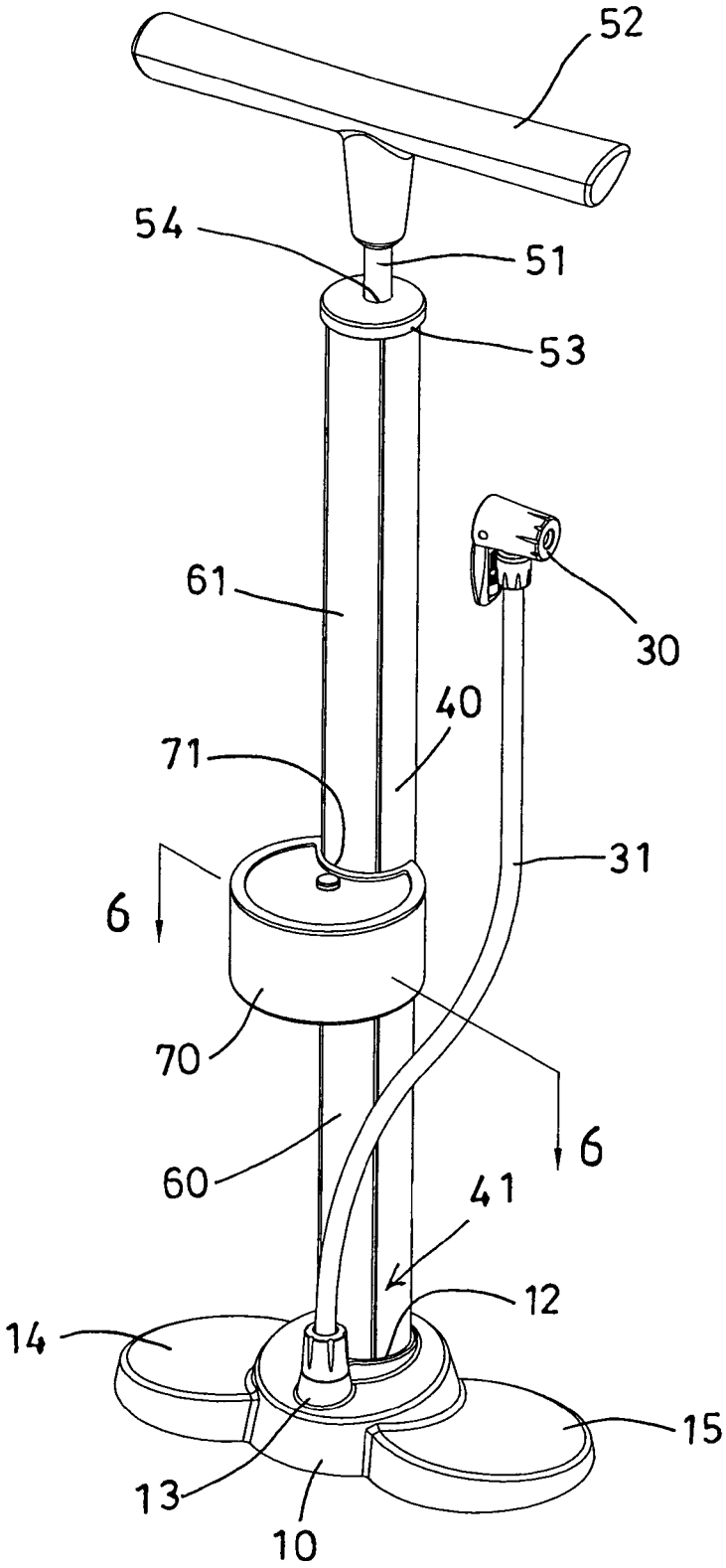
FIG. 5 is a perspective view of the hand air pump.
Figure 6:
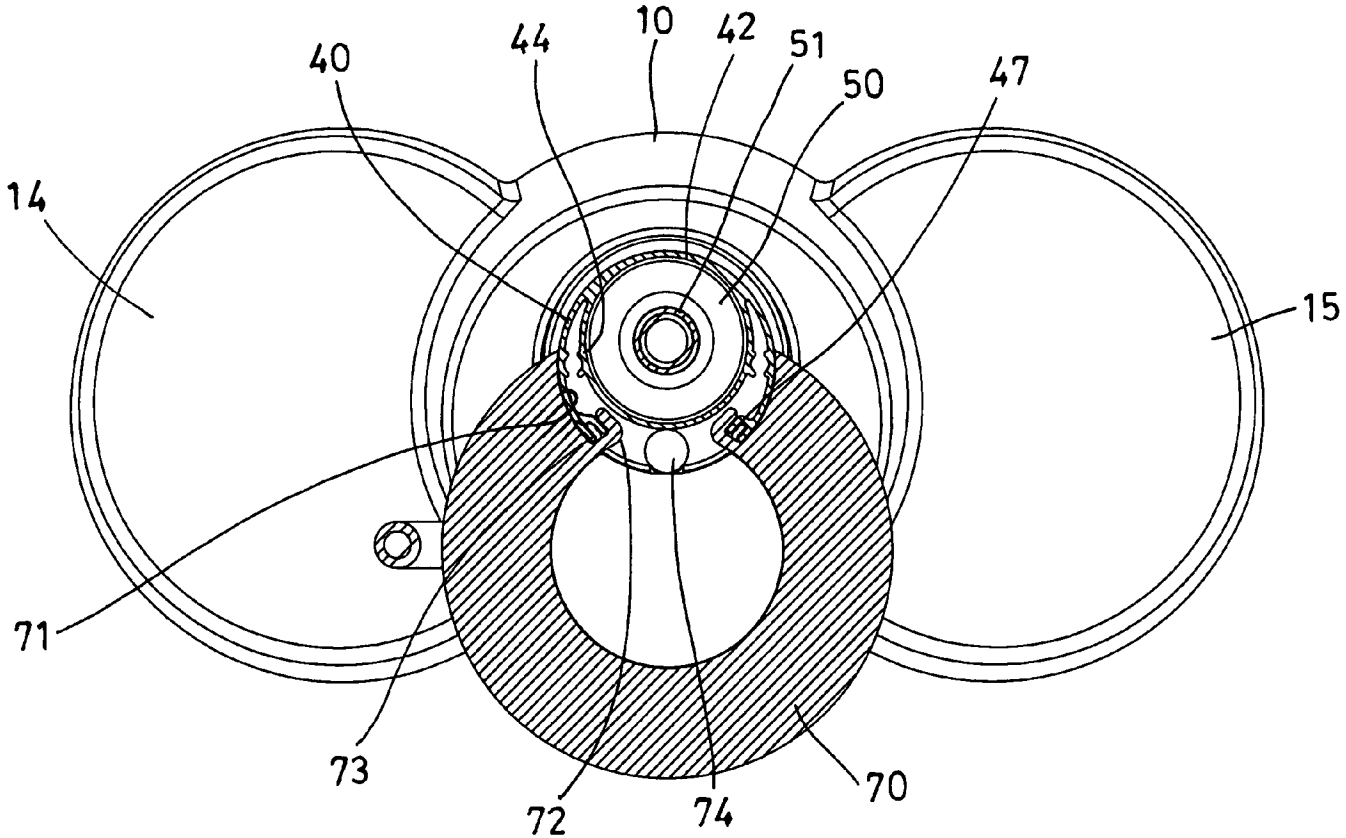
FIG. 6 is a partial cross sectional view of the hand air pump, taken along lines 6-6 of FIG. 5.
Figure 7:
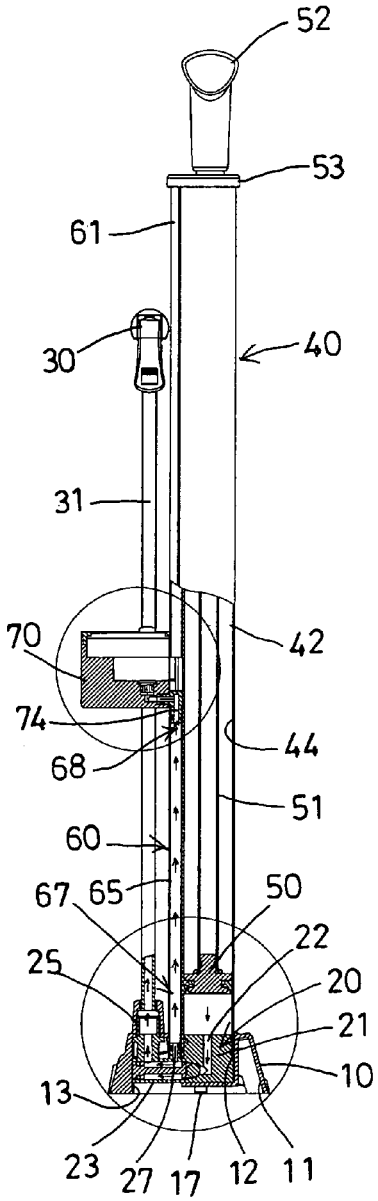
FIG. 7 is a side plan schematic view of the hand air pump, in which a portion of the hand air pump has been cut off for showing the inner structure of the hand air pump.

A cylindrical housing or outer receptacle 40 includes a lower portion 41 received or engaged into the opening 12 of the base 10 and engaged with the peripheral shoulder 24 of the barrel 21 for solidly or stably connecting or coupling or securing or anchoring or retaining the receptacle 40 to the base 10 and the connecting member 20, the receptacle 40 further includes a pump barrel or cylinder 42 disposed or located within the receptacle 40 and having a diameter smaller than that of the receptacle 40, and arranged eccentric relative to the receptacle 40, best shown in FIG. 4, for forming or defining a U or C-shaped space 43 between the receptacle 40 and the cylinder 42, the cylinder 42 is engaged onto the barrel 21 of the connecting member 20 and includes a chamber 44 formed therein and communicative with the bore 22 of the barrel 21.

A piston 50 and a piston rod 51 are slidably received or engaged in the chamber 44 of the cylinder 42 and movable along the chamber 44 of the cylinder 42 for generating a pressurized air and for supplying the pressurized air into the bore 22 of the barrel 21 (FIGS. 7, 8) and the compartment 26 of the tube 23, and for allowing the pressurized air to flow out through the outlet port 25 and/or the mouth 27, and for allowing the pressurized air to flow out through the mouthpiece or nozzle 30 and to inflate various objects (not shown), such as vehicle tires, shoes, inflatable balls or the like, in which the mouth 27 that is extended from the tube 23 is received or extended into the space 43 that is formed between the receptacle 40 and the cylinder 42.

A handle or hand grip 52 is provided or disposed on top of the piston rod 51 for moving the piston 50 along the chamber 44 of the cylinder 42. A cap 53 is disposed or attached or mounted or secured on top of the receptacle 40 for enclosing or blocking the chamber 44 of the cylinder 42 and the space 43 that is formed between the receptacle 40 and the cylinder 42, and the cap 53 includes an aperture 54 formed therein for slidably receiving or engaging with the piston rod 51. The receptacle 40 further includes a longitudinal channel 46 formed therein and formed or defined by two opposite tracks or flaps or flanges 47 (FIGS. 1-4) and communicative with the space 43 that is formed between the receptacle 40 and the cylinder 42, and includes a longitudinal rail or groove 48 formed in each of the flanges 47 (FIG. 4).

One or more (such as two) cover plates 60, 61 are engaged with the channel 46 of the receptacle 40 and each include two side portions 63 slidably received or engaged in the grooves 48 of the flanges 47 of the receptacle 40 for covering or enclosing or blocking the channel 46 and/or the space 43 of the receptacle 40, in which the lower cover plate 60 includes a longitudinal pipe 65 formed or provided or extended therein and located in the space 43 that is formed between the receptacle 40 and the cylinder 42, and having a hole 66 formed in the pipe 65, and the pipe 65 of the lower cover plate 60 includes a lower portion 67 attached or mounted or engaged onto the mouth 27 which is extended from the tube 23 (FIGS. 2, 7-8) such that the hole 66 of the pipe 65 is communicative with the mouth 27 for receiving the pressurized air from the connecting member 20 and the cylinder 42. The other cover plate 61 is not necessarily to include the pipe 65 therein.

The hand air pump in accordance with the present invention further comprises a manometric gauge device 70 including a depression or notch 71 formed therein and having a curvature similar or identical to that of the receptacle 40 for engaging onto the outer portion of the receptacle 40, the gauge device 70 includes one or more (such as two) rails or tracks or latching members 72 formed or provided therein or extended into the notch 71 thereof for slidably engaging with the flanges 47 of the receptacle 40 (FIG. 6) and for anchoring or attaching or mounting or securing or retaining the gauge device 70 to the receptacle 40, for example, the gauge device 70 includes a slot 73 formed in each of the tracks or latching members 72 for slidably receiving or engaging with the flange 47 of the receptacle 40.

Figure 9:
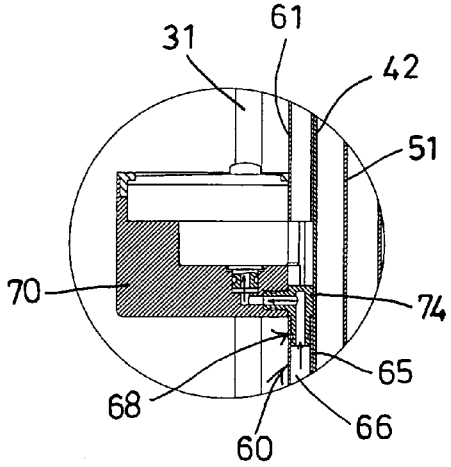
FIGS. 8, 9 are enlarged partial cross sectional views illustrating the operation of the hand air pump.
Figure 10:
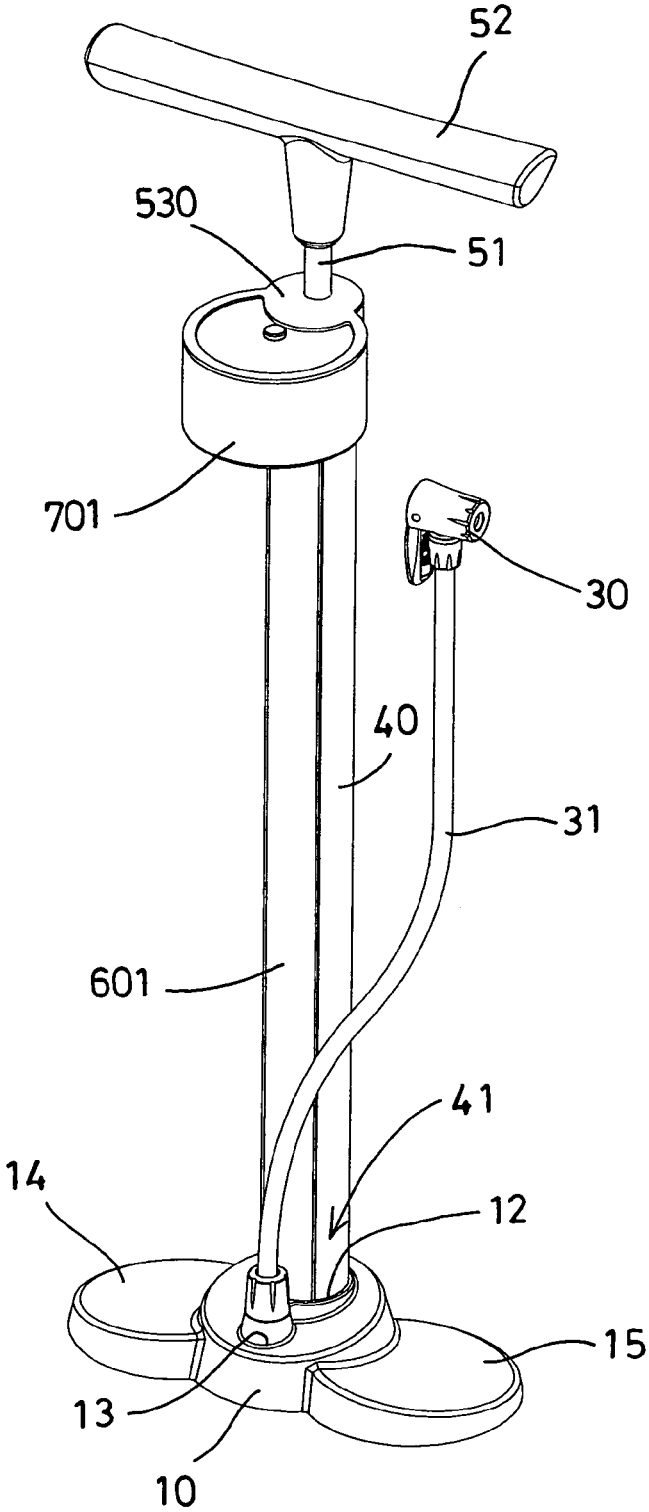
FIG. 10 is a further perspective view illustrating the other arrangement of the hand air pump.

The gauge device 70 further includes a mouthpiece or connector 74 provided or extended therein (FIGS. 2, 6-7 and 9) for engaging into the upper portion 68 of the pipe 65 of the lower cover plate 60 (FIGS. 7 and 9) and for receiving the pressurized air from the connecting member 20 and the cylinder 42 and for measuring or indicating the air pressure within the hollow cylinder 42. The gauge device 70 may be disposed or attached or mounted between the cover plates 60, 61 (FIGS. 3, 5, 7), and the cover plate 61 may be disposed or attached or mounted or retained between the gauge device 70 and the cap 53. Alternatively, as shown in FIG. 10, the receptacle 40 may include a single cover plate 601 engaged with the flanges 47 of the receptacle 40, and the gauge device 701 may be formed integral with the cap 53 and attached or mounted or secured on top of the receptacle 40.

It is to be noted that the gauge device 70 may be suitably attached or mounted or secured onto the outer portion of the receptacle 40 without exposing the coupling slots 73 and latching members 72, or no attaching members or coupling conduits will be exposed, such that the outer appearance of the hand air pump in accordance with the present invention will not be spoiled, and such that the hand air pump in accordance with the present invention may include a smooth and beautiful outer appearance. In addition, the gauge device 70 may be easily and quickly attached or mounted or secured or assembled onto the receptacle 40 and between the cover plates 60, 61 by the users themselves without additional tools.

Accordingly, the hand air pump in accordance with the present invention includes a gauge device that may be easily and quickly and readily assembled to the hand air pump without additional tools and that may be easily and quickly manufactured with a decreased manufacturing fee.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand air pump comprising:

a connecting member including a barrel having a bore formed in said barrel, and including an outlet port and a mouth communicative with said bore of said barrel, a receptacle including a cylinder disposed in said receptacle for forming a space between said receptacle and said cylinder, and including a channel formed in said receptacle and communicative with said space that is formed between said receptacle and said cylinder, said cylinder being engaged onto said barrel and including a chamber formed therein and communicative with said bore of said barrel, said mouth of said connecting member being extended into said space that is formed between said receptacle and said cylinder, a piston slidably engaged in said chamber of said cylinder and movable along said chamber of said cylinder for generating a pressurized air and for supplying the pressurized air into said bore of said barrel and into said outlet port and said mouth of said connecting member, a cover plate engaged with said channel of said receptacle and including a longitudinal hole formed therein and communicative with said mouth of said connecting member, and a gauge device including a notch formed therein for receiving and engaging onto said receptacle, and including at least one latching member engaged with said receptacle for retaining said gauge device to said receptacle, and including a connector extended from said gauge device and engaged with said hole of said cover plate for receiving the pressurized air from said connecting member and said cylinder and for measuring an air pressure within said cylinder.

2. The hand air pump as claimed in claim 1, wherein said connecting member includes a tube extended from said barrel and having a compartment formed in said tube, said outlet port and said mouth are extended from said tube.

3. The hand air pump as claimed in claim 1, wherein said connecting member includes a peripheral shoulder formed in an outer peripheral portion of said barrel and engaged with said receptacle.

4. The hand air pump as claimed in claim 1 further comprising a base including a chamber formed therein for receiving said connecting member, and including an opening and an orifice formed in said base and communicative with said chamber of said base for receiving and engaging with said mouth and said outlet port of said connecting member respectively.

5. The hand air pump as claimed in claim 1 further comprising a nozzle coupled to said outlet port of said connecting member.

6. The hand air pump as claimed in claim 1, wherein said notch of said gauge device includes a curvature similar to that of said receptacle.

7. The hand air pump as claimed in claim 1, wherein said receptacle includes two flanges to form said channel between said flanges, and includes a groove formed in each of said flanges for slidably receiving and engaging with two side portions of said cover plate.

8. The hand air pump as claimed in claim 7, wherein said gauge device includes a slot formed in said at least one latching member for slidably receiving and engaging with said flange of said receptacle and for retaining said gauge device to said receptacle.

9. The hand air pump as claimed in claim 1, wherein said cover plate includes a longitudinal pipe provided therein and located in said space that is formed between said receptacle and said cylinder, and said hole is formed in said pipe, and said pipe includes a lower portion attached to said mouth and includes an upper portion engaged with said connector of said gauge device.

10. The hand air pump as claimed in claim 1, wherein said receptacle includes a cap mounted on top thereof, and said cap includes an aperture formed therein for slidably receiving and engaging with a piston rod which is extended from said piston.

11. The hand air pump as claimed in claim 10 further comprising a second cover plate engaged with said channel of said receptacle and disposed between said gauge device and said cap.

12. The hand air pump as claimed in claim 1, wherein said cylinder is eccentric relative to said receptacle for forming said space which is C-shaped.

* * * * *